United States Patent [19]

Steppe

[11] Patent Number: 4,936,696

[45] Date of Patent: Jun. 26, 1990

[54] ROLLER DEVICE FOR TRANSPORTING RECORDING SUPPORTS IN PRINTERS

[75] Inventor: Erich Steppe, Ulm, Fed. Rep. of Germany

[73] Assignee: Mannesmann Aktiengesellschaft, Dusselforf, Fed. Rep. of Germany

[21] Appl. No.: 256,049

[22] Filed: Oct. 11, 1988

[30] Foreign Application Priority Data

Oct. 8, 1987 [EP] European Pat. Off. ..... 87730123

[51] Int. Cl.[5] ..... B41J 13/036

[52] U.S. Cl. ..... 400/636.3; 400/637

[58] Field of Search ..... 400/605, 636, 636.1, 400/636.3, 637, 637.2, 637.3, 638, 641, 637.4, 637.5, 637.6

[56] References Cited

U.S. PATENT DOCUMENTS

| | | | |
|---|---|---|---|
| 1,004,569 | 10/1911 | Hess | 400/637.2 |
| 1,182,352 | 5/1916 | Corcoran | 400/636.3 |
| 1,207,628 | 12/1916 | Roebuck | 400/637.2 |
| 1,496,876 | 6/1924 | Garbell | 400/637.1 |
| 1,988,189 | 1/1935 | Dobson | 400/637.1 |
| 2,002,361 | 5/1935 | Christian | 400/637.1 |
| 2,328,146 | 8/1943 | Hill et al. | 400/637.2 |
| 2,807,347 | 9/1957 | Metzher | 400/637.2 |
| 4,215,945 | 8/1980 | Habich et al. | 400/636 |
| 4,364,683 | 12/1982 | Shakib et al. | 400/636.3 |
| 4,592,670 | 6/1986 | Frank et al. | 400/637 |
| 4,717,274 | 1/1988 | Kimura | 400/637.1 |

FOREIGN PATENT DOCUMENTS

| | | | |
|---|---|---|---|
| 99120 | 7/1983 | European Pat. Off. . | |
| 209165 | 11/1984 | Japan | 400/637 |
| 193862 | 8/1987 | Japan | 400/636.3 |

OTHER PUBLICATIONS

C.N. Ramirez et al., "Platen Backup Rollers", *IBM Technical Disclosure Bulletin*, vol. 25, No. 1, pp. 202–203, Jun. 1982.

*Primary Examiner*—David A. Wiecking

*Attorney, Agent, or Firm*—Cohen, Pontani & Lieberman

[57] ABSTRACT

Each of one or more groups of pressure rollers (24, 25), consisting of a plurality of pairs of rollers (26), is arranged on its own mounting frame (27) that is releasably carried on the connecting piece (4) of the printer frame (1). The mounting frames (27) are concurrently displaceable by means of a selectively adjustable displacement member (28) disposed parallel to the elongation of the platen roller (6) between a rest position and an operating position for accommodating both tractor-fed edge-perforated continuous forms and individual sheets of recording support material, respectively.

5 Claims, 2 Drawing Sheets

ROLLER DEVICE FOR TRANSPORTING RECORDING SUPPORTS IN PRINTERS

Field of the Invention

The present invention relates to a device for transporting paper or other recording supports in printers, and particularly dot-matrix printers, which are adapted to handle individual sheets or, optionally, endless webs, with and without edge perforations.

BACKGROUND OF THE INVENTION

Paper transport devices which can be used for endless webs and for individual sheets are known. One such known paper transport device, disclosed in European Pat. No. EP-A2-0-099-120, consists of an attachable assembly which, in its horizontal position, transports via the tractors for edge-perforated endless webs and, in its vertical position, transports individual sheets. For individual sheets, however, it is further necessary to place an additionally attachable transport device on the attachable assembly. Such double attachable assemblies cannot be readily manufactured or mounted with sufficient accuracy and result in impermissibly large tolerances. Moreover, because of the need for additional parts, this manner of construction results in a large amount of fabrication work and thus in high costs. The high mounting expenses are also disadvantageous. Furthermore, any required adjustment of the individual parts during mounting is difficult to carry out.

The object of the present invention, therefore, is to provide a printer device for the transport of different recording supports—such as edge-perforated endless paper webs, unperforated endless webs, individual sheets, carbon sets and sets of forms—having a minimum number of parts, the expenses of mounting or attaching the transport device also being taken into account.

SUMMARY OF THE INVENTION

This and other objects are achieved, in accordance with the invention, in a recording support or paper transport device which includes one or more groups of pressing rollers, each group consisting of a plurality of rollers or roller pairs. Each group of pressing rollers is arranged on its own mounting frame, and the mounting frames are selectively and concurrently displaceable by adjustment of a common displacement member from a position of rest to an operating position, and vice-versa. Such a transport device represents a mechanically, structurally and functionally simple yet elegant solution for guiding and advancing a wide range of recording material types including, for example, edge-perforated endless webs, unperforated endless webs, individual sheets, carbon sets and sets of forms. The expense required for achieving this advantageous arrangement comprises merely the provision of a group of pressure rollers which can be quickly and easily connected to or disconnected from, and which is integrated into the office machine or printer. The group of pressure rollers may, preferably, be so arranged proximate or adjacent the circumference of a circular-cylindrical writing base (platen roller) that the individual sheets or the webs of paper can be moved with a firm or snug resting fit on the writing base. In accordance with the invention, there is provided a separation of the guidance and push-pull forces wherein the group of pressure rollers consists onlY of nondriven pairs of rollers.

A particularly inexpensive assemblage is obtained wherein, with the platen roller removed from the printer frame, the mounting frames can be inserted and engaged, or disengaged and removed, through openings in the printer frame. The system can therefore be used to particular advantage in printer constructions in which the platen roller, together with its bearings, can easily be removed.

As a further feature of the invention, the common displacement member may consist of a cross-sectionally D-shaped shaft that is rotatably supported in the sideplates of the printer frame and that extends through cutouts in the roller-carrying mounting frame. The preferred force-locked and/or formlocked association of the D-shaped shaft with these cutouts does not require close tolerances and is therefore particularly inexpensive to manufacture and mount.

Further advantages of the invention reside in the provision, on the outside of one of the frame sideplates, of a user-adjustable setting lever connected with the D-shaped shaft, the pin-shaped end of the lever being guided for movement in an obliquely upward extending recess. The obliquely upward extending recess permits appropriate raising and lowering of the D-shaped shaft with pivoted adjustment of the displacement lever.

Another feature of the invention is that, within the pressure rollers mounting frame, the individual pairs of rollers are mounted so that they protrude, with radial resilience provided by a flat spring member, outward through openings in the upper side or face of the mounting frame. These features insure that the pairs of rollers suitably adapt themselves to sets of forms of different thickness and to thin individual sheets, and assure the desired snug resting of the recording support or paper on the writing base.

Other objects and features of the present invention will become apparent from the following detailed description considered in connection with the accompanying drawings. It is to be understood, however, that the drawings are designed solely for purposes of illustration and not as a definition of the limits of the invention, for which reference should be made to the appended claims.

Brief Description of the Drawing

In the drawing, wherein similar reference characters denote similar elements throughout the several views.

Detailed Description of the Preferred Embodiment

Figure 1:
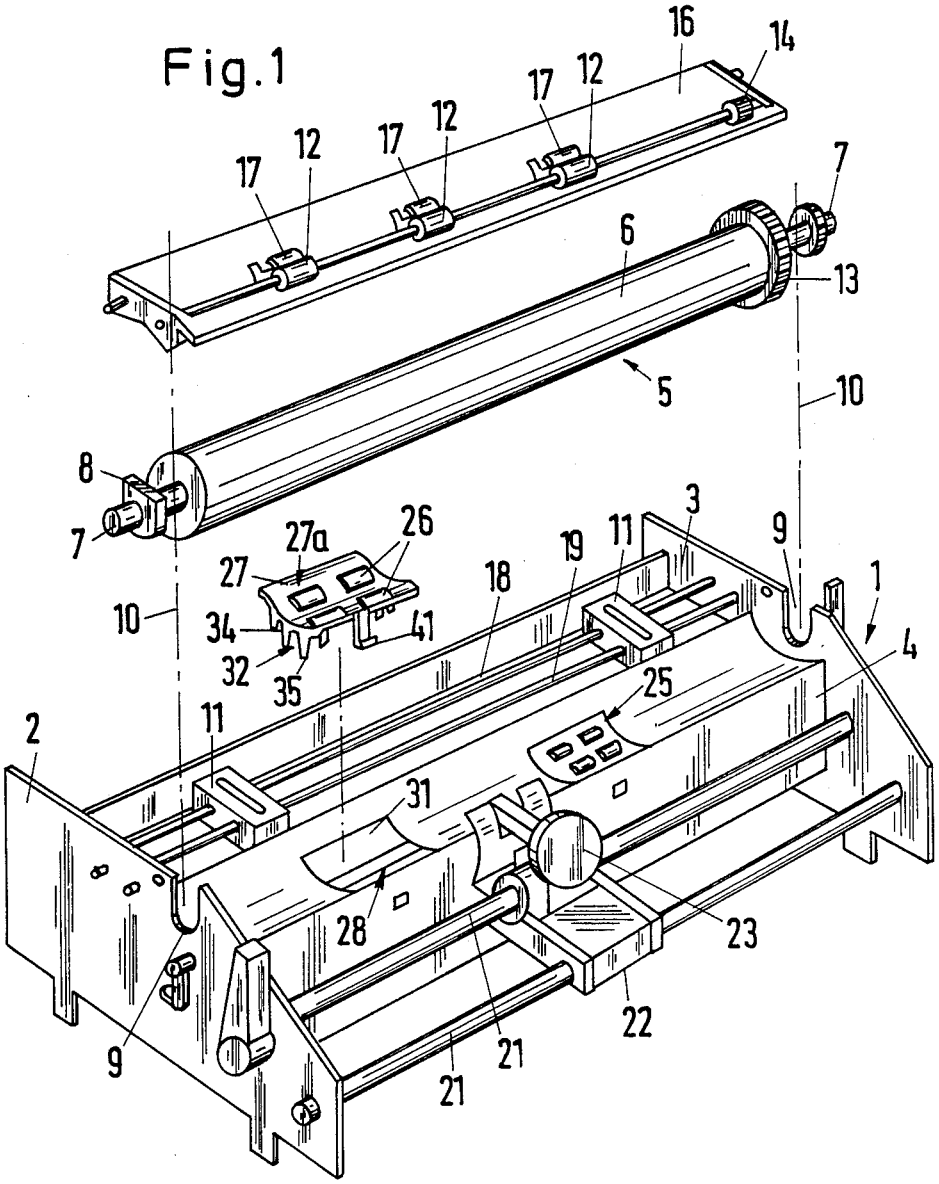
FIG. 1 is an exploded, elevated perspective view of a dot-matrix printer, with the printer housing removed, showing the parts of a paper-transport device constructed in accordance with the invention.

The printer frame 1 consists of the sideplates 2 and 3 and a connecting piece 4 which also forms one side of a paper or recording support guide channel. The connecting piece 4 has a top face of curved configuration to generally conform to the periphery of a platen roller 6 of circular-cylindrical shape which serves as a writing base 5. The platen roller 6 is suspended or supported on frame 1 by means of journal pins 7 which project from the roller ends and by accompanying holders 8 which are received in mounting cutouts 9 in the printer frame sideplates 2, 3. The path of platen roller insertion during its installation on the frame 1 is indicated by the dash-dot lines 10 in FIG. 1.

When the selected writing base 5 consists not of the circular-cylindrical platen roller 6 but instead, for example, of a printing beam, then in addition to a pair of tractors 11 for endless webs, driven pairs of pressure rollers are used in lieu of the driven transport rollers 12 shown in the drawing. In any event, the drive for rollers 12 includes a gear 13 mounted on the rotary shaft of platen roller 6; the gear 13 is, in turn, driven by an electric motor (not shown). Driven gear 13 turns another gear 14 on a shaft 15 which is mounted for rotation within a cover 16 and which carries the plurality of driven transport rollers 12. Nondriven or freewheeling, radially spring-urged counter-rollers 17 are mounted confrontingly opposite the rollers 12 for corresponding rotation therewith within the cover 16.

The tractors 11 are individually or otherwise appropriately adjustable on a shaft 18 and a driveable shaft 19 over the width of an endless web 20 receivable as a recording support in the printer. A print-head carriage 22 which carries an opposable print head 23 is movable in parallel to and along the front of the writing base 5 on a pair of guide shafts 21.

Figure 2:
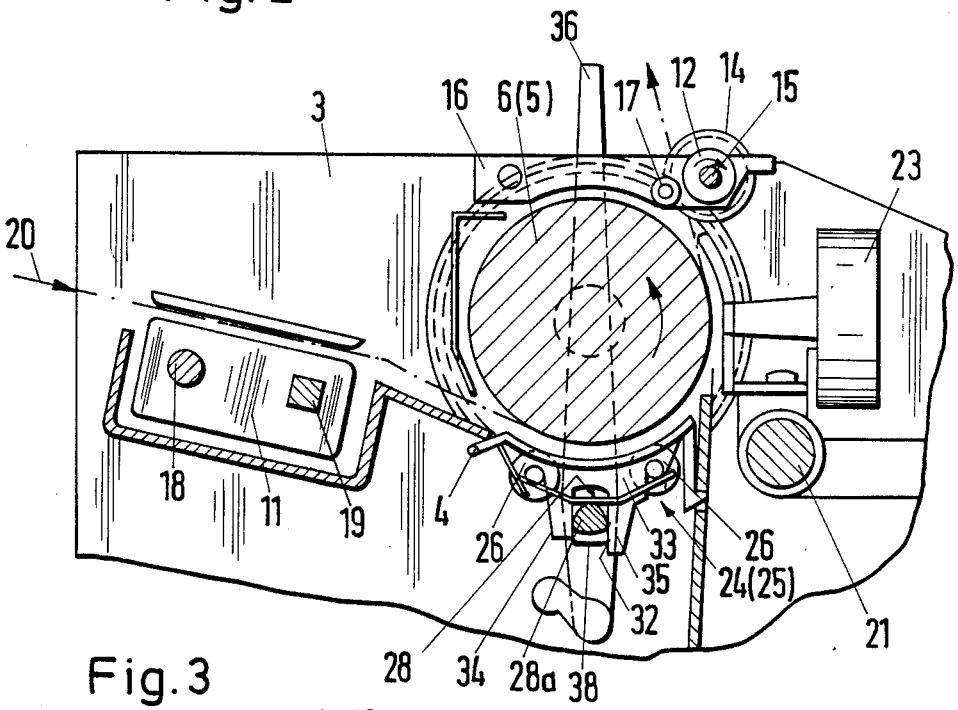
FIG. 2 is an end view, in partial section, of the dot-matrix printer of FIG. 1 shown in its "endless web" operating condition.

FIG. 2 illustrates the printer setup for receiving an endless web 20 of recording material or paper. For this 37 endless web" function, the drive for the tractors 11 is connected so that the endless web 20 is moved along the curved surface of the connecting piece 4 and around the periphery of the platen 6 to the front of the print head 23. At this position, the print head 23 is operated to print on the web 20 which is then transported or directed out of the printer or office machine by the transport rollers 12 and counter-rollers 17.

Below the platen 6 are arranged groups 24 and 25 of pressure rollers, each of which groups comprises several pairs of rollers 26. Each group 24, 25 of pressure rollers is mounted on a separate frame 27, for example of plastic, which is adapted to the curvature of the top surface of the connecting piece 4. The mounting frames 27 are concurrently operatively displaceable, by a common displacement member 28 disposed substantially parallel to the elongated periphery of the platen 6, from a position of rest into an operating position, or vice-versa. In FIG. 2, the mounting frames 27 are shown in their rest position wherein no frictional forces are exerted by the frames 27 or rollers 26 on the endless web 20.

Figure 3:
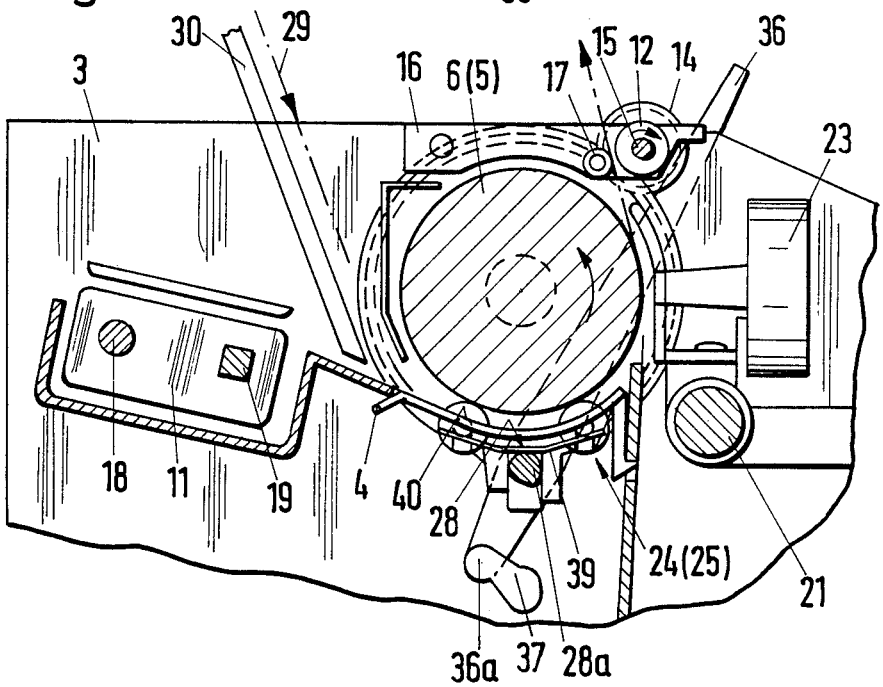
FIG. 3 is an end view, similar to FIG. 2, of the printer shown in its "single sheet" operating condition.

FIG. 3, on the other hand, illustrates the printer setup for receiving a recording material consisting of a single sheet, or an endless web lacking edge perforations, or for automatic feeding of individual sheets.

For this "single sheet, endless web without edge perforation and automatic sheet feed" function, the displacement member 28 is actuated from its FIG. 2 position. When so actuated, the frames 27 are displaced to their FIG. 3 position whereby the recording material—such as an individual sheet 29 —is directed by an individual sheet guide 30 and is frictionally pressed between the pairs of rollers 26 and the periphery of platen roller 6.

The mounting frames 27, their actuating means and their mounting on the printer frame 1 will now be described in further detail. As shown in FIG. 1, the mounting frames 27 are inserted into the respective openings 3 with the platen 6 removed from the printer frame 1. Of course, during initial assembly of the printer the mounting frames 27 can be introduced into the openings 31 before the platen 6 is seated on the sideplates 2, 3. The common displacement member 28 is formed by a cross-sectionally D-shaped shaft **28*a* which extends through cutouts 32 in the mounting frames 27. The cutouts 32 are defined by guide spars 34 and 35 which extend vertically from the mounting frame rib walls 33 to the left and right of D-shaped shaft 28*a*. On the outside of one of the sideplates 2, 3 the D-shaped shaft 28*a* is connected to a setting lever 36. Setting lever 36 has a pinshaped end 36*a* which is guidedly movable in and about an obliquely upwardly extending cutout 37 in the sideplate. The shaft 28*a* is itself guided in slots 38 in the sideplates 2 and 3, and within which slots its D-shaped cross section slides at different heights, i.e. in accordance with FIG. 2 at a bottom height and in accordance with FIG. 3** at a top height.

The individual pairs of rollers 26 are notably mounted so that they partially extend through openings 40 in the frames 27. More particularly, a flat spring member 39 presses against the shafts or supports of the rollers 26, causing the rollers to protrude with radial resilience at the upper face or side **27*a* of the mounting frame. Consequently, the rollers 26, together with the mounting frame 27, can be readily installed or removed as a single unit (FIG. 1). The rib walls 33, in this connection, carry depending detent arms 41 which are resiliently or similarly flexibly movable or deformable under spring-like action in a direction transverse to the direction of guided movement of the printhead carriage 22**.

Following installation of the mounting frames 27 in the connecting piece openings 31, the groups of rollers 24, 25 are pressed, with a substantially uniform distribution of force over all of the rollers 26, against the peripheral surface of the platen 6. Unevennesses and different thicknesses of the recording material or paper, as well as concentricity tolerances, are automatically compensated for by the resilient radial movement of the pairs of rollers 26 under the urgency of the spring plate 39. The shafts which support the rollers 26 remain, in this arrangement, substantially parallel to the platen roller 6.

While there have been shown and described and pointed out fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. A printer for accommodating a recording support, comprising:

a printer frame (1) including an obliquely upward extending cutout (37);

an elongated platen roller (6) about which the recording support is operatively transportable; and means for accommodating transport through said printer of a variety of thicknesses of recording supports, comprising:

a plurality of pressure rollers (24, 25);

a mounting frame (27) carrying said plural pressure rollers (24, 25), said mounting frame (27) being operatively supported by said frame (1);

a selectively adjustable displacement member (28) comprising a shaft (28*a*) having a predetermined cross-sectional contour and supported on said printer frame (1) substantially parallel to the elongation of said platen roller (6), said shaft operatively engaging said mounting frame (27) and being selectively movable for adjustably moving said mounting frame (27) between a first position in which said pressure rollers (24, 25) are pressed into substantial abutment with said platen roller (6) and a second position in which said pressure rollers (24, 25) are disposed in closely proximate but spaced relation to said platen roller (6) so as to accommodate a variety of thicknesses of recording supports between said pressure rollers (24, 25) and platen roller (6); and a setting lever (36) having opposed first and second (36*a*) ends and connected to said shaft (28*a*) intermediate said opposed ends, said first end being disposed for selective user-manipulated movement so as to move said shaft (28*a*) and thereby adjustably move said mounting frame (27) between said first and second positions, and said second end (36*a*) being disposed in relatively movable engagement with said printer frame cutout (37) so that, as said first end is selectively moved by user manipulation, said second end (36*a*) is guided for movement in and along said cutout (37) to thereby control the movement of said shaft (28*a*) and said mounting frame (27) between said first and second positions.

2. A printer for accommodating a recording support, comprising:

a printer frame (1);

an elongated platen roller (6) about which the recording support is operatively transportable; and means for accommodating transport through said printer of a variety of types and thicknesses of recording supports, comprising:

a group of pressure rollers (24, 25) including a plurality of roller pairs (26);

a mounting frame (27) carrying said roller pairs (26) of the pressure roller group (24, 25), said mounting frame (27) being operatively supported by said frame (1);

a selectively adjustable displacement member (28) supported on said printer frame (1) substantially parallel to the elongation of said platen roller (6) and associated with said mounting frame (27) for selectively moving said mounting frame (27) between a first position in which said pressure rollers (24, 25) are pressed into substantial abutment with said platen roller (6) and a second position in which said pressure rollers 24, 25) are disposed in closely proximate but spaced relation to said platen roller (6) so as to accommodate a variety of types and thicknesses of recording supports between said pressure rollers (24, 25) and platen roller (6), said displacement member (28) comprising a selectively rotatable shaft (28*a*) having a substantially D-shaped cross-section and operatively engaging said mounting frame (27) for moving said mounting frame (27) between said first and second positions as said shaft (28*a*) is selectively rotated for accommodating transport of a variety of types and thicknesses of recording supports through said printer; and a setting lever (36) connected to said D-shaped shaft (28*a*) for rotation therewith, said lever (36) having a pin-shaped end, and said printer frame (1 having an obliquely upward extending aperture (37) for receiving said shaft end and for guiding said shaft end along said aperture (37), as said shaft (28*a*) is rotated by user movement of said setting lever (36), so as to shift said mounting frame (27) between said first and second positions.

3. A printer in accordance with claim 2, wherein said printer frame (1) includes a member (4) having an opening (31) defined therein for receiving said mounting frame (27), and said platen roller (6) is rotatably and removably supported by said printer frame (1) such that said platen roller (6) overlies said opening (31) when supported by said printer frame (1), said mounting frame (27) being releasably removable from and receivably insertable in said opening (31) when said platen roller (6) has been removed from supported position on said printer frame (1).

4. A printer in accordance with claim 2, wherein said mounting frame (27) includes a plurality of openings (40) therein and a spring member (39) associated with said pressure rollers (24, 25) for causing said pressure rollers (24, 25) to resiliently protrude through said mounting frame openings (40) in the direction of said platen roller (6).

5. A printer in accordance with claim 2, further comprising at least one additional mounting frame (27), and wherein said displacement member (28) is operatively associated with all of said mounting frames (27) for concurrently moving said mounting frames (27) between said first and second positions.

* * * * *